US007735719B2

(12) United States Patent
Crum

(10) Patent No.: US 7,735,719 B2
(45) Date of Patent: Jun. 15, 2010

(54) POCKETED BUSINESS COMMUNICATION ASSEMBLY HAVING RESILIENTLY BIASED ATTENTION DIRECTION PIECE IMAGED WITH MATCHING INDICIA

(75) Inventor: Jesse D. Crum, Fort Scott, KS (US)

(73) Assignee: Ward/Kraft, Inc., Fort Scott, KS (US)

( * ) Notice: Subject to any disclaimer, the term of this patent is extended or adjusted under 35 U.S.C. 154(b) by 1215 days.

(21) Appl. No.: 11/305,374

(22) Filed: Dec. 16, 2005

(65) Prior Publication Data

US 2007/0194566 A1 Aug. 23, 2007

(51) Int. Cl.
*B65D 33/16* (2006.01)
*A63H 33/38* (2006.01)

(52) U.S. Cl. ..... 229/67.1; 40/124.03; 40/124.06; 40/124.08; 446/148; 446/150

(58) Field of Classification Search ..... 229/67.1–67.4, 229/92.1, 92.3, 92.8; 40/124.01, 124.03, 40/124.06, 124.08, 124.14, 124.15; 283/56, 283/61; 281/2, 5; 446/147–152, 486
See application file for complete search history.

(56) References Cited

U.S. PATENT DOCUMENTS 2,171,656 A * 9/1939 Kislevitz ..... 40/539
4,774,780 A * 10/1988 Crowell ..... 40/124.08
4,963,125 A * 10/1990 Volkert ..... 493/334
5,055,084 A * 10/1991 Jokic ..... 446/486
5,098,129 A * 3/1992 Haber ..... 283/62
5,275,285 A * 1/1994 Clegg ..... 206/449
5,577,918 A * 11/1996 Crowell ..... 434/319
5,933,989 A * 8/1999 Volkert et al. ..... 40/124.08

* cited by examiner

*Primary Examiner*—Nathan J Newhouse
*Assistant Examiner*—Peter Helvey

(57) ABSTRACT

The present invention is related to a pocketed business communication construction, such as a presentation folder, that includes at least one independently, automatically erectable piece for displaying promotion of marketing, advertising or contact information. The assembly is used to contain complimentary and related printed pieces which are held by one or more sleeves or pockets integrally connected to a variably imaged substrate. One or more passive retaining means are provided integrally with at least one of the pocketed configurations to removably hold a biased attention direction piece. The piece is printed with matching and/or complimentary information to that contained by the pocketed communication.

20 Claims, 6 Drawing Sheets

POCKETED BUSINESS COMMUNICATION ASSEMBLY HAVING RESILIENTLY BIASED ATTENTION DIRECTION PIECE IMAGED WITH MATCHING INDICIA

CROSS-REFERENCES TO RELATED APPLICATIONS

None.

FIELD OF THE INVENTION

The present invention is related to a pocketed business communication construction, such as a presentation folder, that includes at least one independently, automatically erectable piece for displaying promotion of marketing, advertising or contact information. The assembly is used to contain complimentary and related printed pieces which are held by one or more sleeves or pockets integrally connected to a variably imaged substrate. One or more passive retaining means are provided integrally with at least one of the pocketed configurations to removably hold a biased attention direction piece. The piece is printed with matching and/or complimentary information to that contained by the pocketed communication.

BACKGROUND OF THE INVENTION

There are currently a plethora of business communication constructions, marketing and advertising pieces and other items that are available in the market today for communicating products and services with an intended audience. Yet with this inordinately large selection of offerings and permutations, there remains a continuing need to develop new products due to changes in technology, societal trends, diversification of marketing, packaging and advertising campaigns and new information handling needs of businesses and consumers alike.

Stock presentation folders are generally well known today and are provided in a variety of colors and typically in several standard formats. Such stock products are created from a blank of material to which at least one and usually two pockets are provided on the inner face of the blank. The pockets are generally formed from the same sheet or blank and are then folded over onto the blank and sealed to the blank to create the pockets. The blank is then folded, usually centrally, to form two relatively equal sides.

Such folders are used in a number of applications ranging from academic, such as in elementary, middle school, high school or collegiate environments and for other education purposes including seminars and technical symposiums. In addition, folders have also been used in the past to hand out information on products and services in the hopes of inducing purchases or sales of such products or services such as may be the case with marketing and advertising campaigns and in connection with professional development activities and services.

These prior art folders have been generally provided in a broad spectrum of colors and can even have different finishes such as glossy or a metallic appearance in order to supplement the product of topic offering. In addition, such prior art products may also be provided with textural or tactile features so as to resemble grains in leather or wood, again all in an effort to produce or tailor the communication vehicle to the audience or presenter to garner more attention for the products or services being offered.

Examples of such prior art folders include U.S. Pat. Nos. 3,870,223, 4,109,850, 4,301,962, 4,731,142, 4,989,777 and 5,836,507. Each of these prior art constructions are constructed from a single blank of material. That is, the portion making up the folder which comprises the pocket, are part of the same blank. The portion which becomes the pocket is then folded onto the folder portion to create the pocket portion. Such constructions normally require the manufacturer to purchase expensive and complicated folding equipment in order to process and fold the pocket portion, see for example U.S. Pat. Nos. 5,439,436 and 6,063,226.

One of the difficulties with such stock folder products is that the user of such products must order the folders in large lots or amounts, or must select the folder from a generic stock inventory that may only have a pre-determined number of colors or finish options. If a presenter or distributor would prefer to have at least limited information printed on the folder, such as the name of the company or presenter or to have certain colors or finishes that represent the company, such as to emphasize the trade dress, then the user is stuck with the unfortunate option of having to order such products in large quantities typically greater than 50 and more and often more typically in the hundreds or thousands of pieces as the set up for the production or manufacture of folders is complex and orders in the hundreds or thousands of units is normally required by the manufacturer due to the complexity associated with such set up of equipment. This dilemma has apparently, unfortunately thwarted the growth of the folder industry and prevented the use of this tool from expanding its utilization and communication potential to users of the product as an advertising vehicle.

The difficulty with current stock folder offerings is that the purchaser must also select from a number of pre-arranged configurations. If all business, products and marketing tools were also standardized, this would not be a problem. However, in an effort to market products, marketing and advertising materials come in an array of shapes, sizes and substances. Thus, a standard configuration may not lend itself to an advertising or marketing message that has a particular "map" or arrangement that requires different pieces to appear in different areas.

Another problem faced by users of such stock folders is that they have virtually no personalized or individualized information. For example, in a typical introductory business meeting between two entities, the attendees may include an executive, members of sales and marketing and production personnel. Distributing the exact same information to each attendee may result in the information simply being deposited into the attendee's files, instead of the presenter's intent of delivering a specific message to each participant. Any personalized or individualized information is then limited to the sheets that are included inside the folders and those specific to a particular attendee may be buried deep within myriad of pages of information provided to the attendees. Alternatively, some level of personalization can be applied through the application of labels to the exterior of the folder.

Attempts at personalization or individualization have sometimes been elaborate, such as that illustrated by U.S. Pat. No. 5,882,038 in which a personalized sheet is printed and then inserted so that the personalized information is then visible through die cut windows in the blank. As one might imagine, this limits the amount of personalization that can be provided and also requires that the information be aligned with the windows in the folder assembly so that it is visible. In fact, this construction highlights the difficulty in providing personalization in a custom or stock folder offering.

In addition to the foregoing problems enumerated above as well as the steps of folding the blank and the equipment required to achieve those tasks, in order to manufacture such a product one needs to add additional die cutting stations and then is faced with the challenge of inserting the personalized sheet of information. In preparing for a meeting, even a small meeting, having to insert 10 sheets into 10 different folders can be time consuming, particularly if one is rushed in trying to get to the meeting.

Pop-up advertising assemblies are also relatively well known in the art such as shown in U.S. Pat. Nos. 4,874,356, 4,867,480, 4,833,802 and 4,349,973 each of which disclose pop-up configurations which have historically been provided with greeting cards, promotional or direct mailing pieces, in store or retail type displays and the like. Pop-up configurations have also widely been used in illustrating literary works, particularly books and other publications that have been used to increase readership among children.

What is needed therefore is a communication piece that is self erecting, can be produced economically and efficiently and is provided in connection with a pocketed business communication piece such as a presentation folder. A combination attention direction device along with a pocketed business communication that can be imaged with matching personalized indicia can then be used to convey a complete message.

Publications, patents and patent applications are referred to throughout this disclosure. All references cited herein are hereby incorporated by reference.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Surprisingly, it has been discovered that self erecting attention directing devices having matching indicia to a pocketed business communication piece have heretofore not been provided in which each piece and attention direction device can be prepared in small quantities and potentially at relatively high resolution levels to meet the individual needs of an end user or customer. The attention directing device is provided in a removable configuration such that after the device can be utilized to communicate its message, and then be conveniently removed so as not to obscure additional personalized or variable printing that has been provided on the business communication pieces or other inserts held by the pockets of the configuration.

By producing such personalized configurations with the added feature of an attention directing device, important information such as contact details or special offers can be easily and readily brought to the attention of the recipient.

In one exemplary embodiment of the presently described invention, a pocketed business communication that has an attention directing feature has been provided and includes a substantially planar blank of material, such as cellulose, that has first and second faces with each face having first and second sides. The blank also has first and second transversely extending edges and first and second longitudinally extending sides that define the outer periphery of the blank. The blank further includes a central fold line that extends substantially medially of the blank and extends between the first and second transversely extending edges and runs parallel to the first and second longitudinally extending sides.

Continuing with a description of the presently described embodiment, the first and second pockets are disposed on the first face with the first pocket being provided on the first side and the second pocket positioned on the second side. The first and second pockets are configured and placed so as to be adjacent the second transversely extending edge and are the pockets are separated from one another by the fold line. One of the first and second pockets has a passive retaining attachment area for holding an erectable attention directing device.

The presently described embodiment includes an automatically erectable attention directing device. The device has first, second and third panels with the third panel being larger than each of the first and second panels. The first panel includes an arcuate end edge. The first panel is connected to the second panel along a first fold line and the second panel is connected to the third panel along a second fold line running parallel to the first fold line. The first panel is folded about the first fold line so as to be partially disposed over the second panel and the third panel is folded about the second fold line so as to be partially disposed over the first and second panels. The second and first panels are further connected to one another by a resilient biasing piece to create the erectable attention directing device.

The erectable attention directing device is held to the one of the first and second pockets by the passive retaining attachment area, such that when the blank is folded about the fold line the erectable directing device is held in a first closed position. When the blank is in a substantially planar or open position, the erectable directing device is in a second position such that the third panel is displayed at an angle greater than about twenty degrees from the second panel.

In yet a still further exemplary embodiment prepared in connection with the present invention a pocketed presentation folder assembly having an attention directing feature is described and includes a presentation folder that has first and second faces with each face having first and second sides. Each of the first and second sides of the first face has a pocket that is disposed along a bottom end edge and the presentation folder and includes a fold line that substantially divides the faces into equal portions.

An attention directing feature is provided in connection with the presently described embodiment and includes first, second and third panels with the first panel connected to the second panel along a first fold line. The second panel is connected to the third panel along a second fold line. The first panel has an arcuate end edge opposite the first fold line and the first panel is resiliently biased against the second panel by an elastic member.

The attention directing device described herein is operable between a first substantially flat position and a second open position. In the open position, the third panel is inclined and raised an amount greater than about thirty degrees from the second panel and the first panel is raised an amount greater than about ten degrees from the second panel. The third panel overlies at least a portion of the first panel and the second panel.

A sound producing device is connected to one of the first and second pockets and the attention directing feature is disposed in proximity to the sound producing device and is attached to one of the first and second pockets such that when the attention direction feature is in the second position the sound producing device presents a message.

In a yet still further exemplary embodiment of the presently described invention, a presentation folder that has a plurality of pockets and an erectable attention directing device is presented and includes a presentation folder that has first and second faces and first and second sides with each side of the first face having a pocket.

An attention directing device is provided with this assembly, and the device includes first, second and third panels with the first panel connected to the second panel along a first fold line and the second panel connected to the third panel along a second fold line. The first panel has an arcuate end edge that is opposite the first fold line and the first panel is resiliently biased against the second panel by an elastic member. The attention directing device is operable between a first substantially flat position and a second open position in which the third panel is inclined and raised an amount greater than about thirty degrees from the second panel. In the open position, the first panel is raised an amount greater than about ten degrees from the second panel. The third panel overlies at least a portion of the first panel and the second panel.

The first and second panels each further include a pair of slits, with the slits in the second panel running parallel to the slits in the first panel and the elastic member placed such that a portion of the elastic member is positioned in each of the slits. Each of the presentation folder and the attention directing device containing matching indicia printed at a resolution of greater than about 150 lines per inch.

These and other objects of the invention will become clear from an inspection of the detailed description of the invention and from the appended claims.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
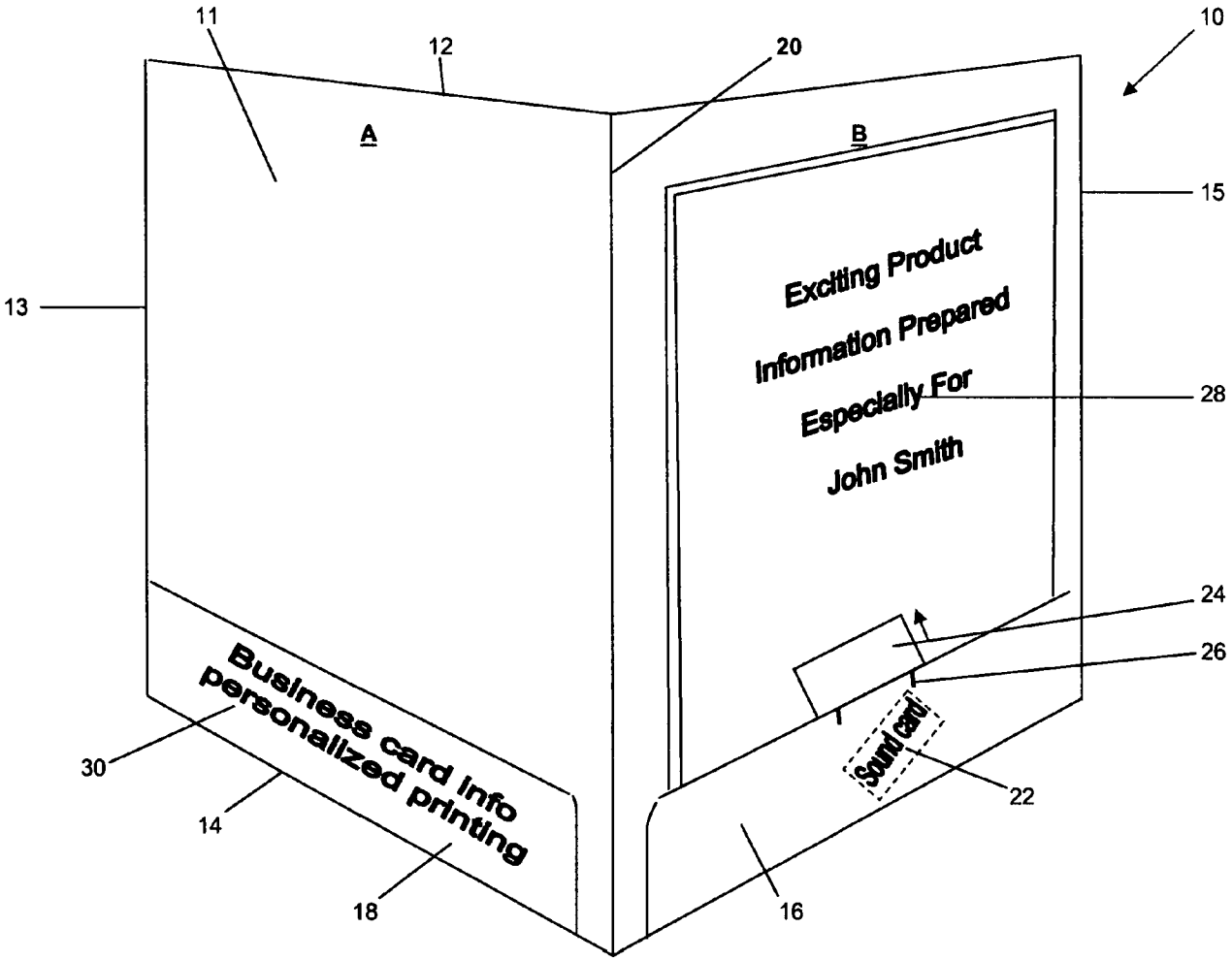
FIG. 1 depicts a front, open view of the pocketed business communication provided in connection with the presently described invention.

The present invention is now illustrated in greater detail by way of the following detailed description which represents the best presently known mode of carrying out the invention. However, it should be understood that this description is not to be used to limit the present invention, but rather, is provided for the purpose of illustrating the general features of the invention.

The invention of the presently described embodiments relates to a pocketed business communication, such as a two pocket presentation folder. The business communication may be provided with personalized imaging either alone or in combination with static or fixed imaging. In addition, the pocketed business communication of the present invention is also shown with a sound emitting device as well as an attention directing piece which operates from a closed position to an open position in order to further identify unique communication points of the assembly, such as the name of the issuer or provider of the piece.

The presentation folder is generally prepared from a planar blank of material that is imaged with the relevant information. The blank may then be die cut to form the pocket portions which are then folded over onto the blank and sealed to create the assembly. Alternatively, pocket portions can be created separately from the blank and then laminated to the assembly by patterns of adhesive.

For illustrative purposes only, each panel or section of the presentation folder or folder page will have a width of approximately 9 inches and a length of about 12 inches. Together, two panels are generally required to create a presentation folder with the overall dimensions running about twelve inches high by eighteen inches wide. The pockets that are created in connection with the present invention will have a height of around 4" to 4¼" and a width of up to 9 inches, which resembles a relatively standard rectilinear or generally quadrate pocket configuration. Other configurations are of course possible depending on the needs of the end user.

The present invention may have pockets of any dimension or shape depending on the desire or intended use of the end user or customer. In addition, the pocket type may be confined within an area of just one panel or section or may extend across both panels or sections or portions thereof. The second pocket may be smaller than the first pocket type so that it can serve to carry supplemental material such as business cards, discs, diskettes, samples, prizes and other collateral material which may be too small to be placed in a larger pocket. It should be understood that the second pocket may also be larger than the first pocket so as to be able to accommodate bulkier sheets or materials.

The foregoing dimensions are used when preparing a standard configuration presentation folder. That is, each panel of the blank that will form the presentation folder runs about 12" high and about 9" wide with the pocket having a length of about 9" and a height of around 4". Obviously, other dimensions are possible and would simply require the repositioning of the adhesive areas, lines of weakness, etc. on the sheet or the use of different sized sheets of material. The pocket of the presently described embodiment is sized and configured so that it can receive and retain a standard size sheet of paper in a portrait arrangement (8½" side placed in the pocket which has a width of approximately 9"). The paperboard or other material used in connection with the present invention may be provided in a cut sheet arrangement or may be obtained in a continuous or roll format.

There are a number of terms used throughout the instant specification which are discussed below in cursory terms. The definitions provided are not intended to limit the scope of the invention and the information is provided for illustrative purposes.

As used herein, the term "adhesive" includes, but is not limited to strips, patterns, segments, shapes, spots, continuous arrangements, discontinuous arrangements and combinations thereof as well as transfer tape configurations in which a removable release strip is provided over the top of an adhesive. The type of adhesive that may be used includes but is not limited to repositionable, removable, permanent, remoistenable, hot melt, pressure seal (cohesive), cold glues and combinations and mixtures thereof. The present invention may also include adhesive strips that are provided in the form of transfer tapes, pressure sensitive tapes and the like which usually will have a removable release liner, which when removed will expose and/or activate the adhesive that can be used to form a sealing arrangement.

As used herein the term "business communication" is used to refer to a printed or imaged piece, document or substrate that when used with the a laminate as described in the present invention will convey a particular message, image or provide information about a particular product or service that is available from the provider of such pieces or documents. Business communications, documents or pieces can include advertising, sales and marketing collateral and such other items used to convey information, and in connection with the present invention.

The term "personalized information" refers to information that is printed or imaged onto a substrate or document which is generally variable or unique and which may change from business communication to business communication so as to create a customized message or communication for each recipient. Examples of personalized information may include names, addresses, descriptions, plans, coding, numbering, promotional text, recipes based on contents, etc. that may have been acquired from the intended recipient through surveys, questionnaires or answers given to various inquiries generated in response to a request for goods or services.

The term "static or fixed" information refers to printed or imaged information that generally does not change from business communication to business communication and may include a general description or body of information about particular products, services, places, etc. that may be of interest to the intended recipient and represents a standard message that the manufacturing or supplier wishes to convey to an end user or customer of the offering.

Examples of image generating or high quality printing devices that are suitable for use in practicing the invention include high resolution imaging devices such as Indigo®, available from Hewlett Packard of Palo Alto, Calif. or Karat available from KBA of Williston, Vt. Ideally, the present invention seeks to provide images on a substrate that has a resolution quality of about 150 or more lines per inch and preferably more than 300 lines per inch, which is approximately equal to about 2500 to 3500 dots per inch ("DPI") in order to create a high quality image that is intended to be aesthetically appealing to the consumer. Other imaging equipment may of course be used depending on the sheet or web size that the equipment can efficiently handle.

For a point of reference, typically, screens that have rulings of about 60 to 100 lines per inch are normally used to make halftone printed images for newspapers. Screens with about 120 to 150 lines per inch are commonly used today to produce images for magazines and commercial printing. Such screens are regularly produced by electronic dot generation.

Electronic dot generation is normally performed by computers that use unique screening algorithms, in cooperation with electronic scanners and image setters, to produce halftone images that are to be subsequently used to render an image. The pixels of digitized images are first assembled into dots that are then used to form shapes, sizes, rulings, etc. which create the ultimate image produced on the substrate.

The printing or imaging that is envisioned in connection with the present invention can be provided on one or both faces of the sheet, blank or substrate. The information to be provided is generally intended to be personalized or individualized so that each attendee of a business meeting, package recipient or other individual or business can receive a specially tailored message, however, it may also contain fixed or static information or combinations of both. For example, in anticipation of attending a business meeting, the attendees from the target company (company that is being targeted for the sale of goods or services) may have an executive present, members of the sales and marketing team as well as production personnel in attendance to consider the information being provided.

Turning now to FIG. 1 which shows a front, open view of a presently described pocketed business communication piece in which a presentation folder is generally referenced by numeral 10. The blank of material that is used in the construction of the assembly, will preferably be selected from a cellulosic stock, including specifically board or tag stock and ranging from about 60 to 120 pounds. Other materials such as films are of course also suitable for preparation of the invention.

The folder includes first and second faces, only the first face 11 is shown in this FIG. 1, but it should be understood that the folder assembly will have first and second faces. The folder 10 includes first and second transversely extending edges 12 and 14, respectively and first and second longitudinally extending sides 13 and 15, respectively. The first face 11 has first and second sides which are depicted by reference to characters "A" and "B", respectively.

Each of the sides "A" and "B" are provided with pockets 16 and 18 which will preferably be used to hold one or more pre-printed sheets of material, samples of a product offerings and other items that can be sized and configured to fit within the pockets. The sides "A" and "B" are separated from one another by a medial fold line 20 which, in a preferred embodiment divides the first face 11 into two substantially equal sides. It should however be understood that the sides may be divided unequally, that is one side is larger than the other in which case one pocket may be larger than the other, rather than the depiction of the relatively equal sized pockets that are shown in present FIG. 1.

Also shown in FIG. 1 is a sound emitting device 22 which is shown in phantom as the device has been positioned beneath the pocket 16 so that it will remain unseen, but will be heard when the pocketed business communication device 10 is opened. The sound emitting device 22 generally operates by a switch that is sensitive to pressure or light, such that when side "A" is lifted off of the emitting device the switch will be activated to initiate the playing of a pre-recorded message.

FIG. 1 also provides a depiction of the positioning of the attention directing device 24 as well as the passive restraining means 26, depicted as slits in the pocket 16, that is used to hold the device 24 in connection with the pocket so that it may be operable between first and second positions as will be described herein. In addition to the use of slits to hold the device 26 in position, other passive retaining means may be used such as removable or repositionable or other light tack adhesives, transfer tapes and the like.

The device 26 may be produced in any suitable configuration and may include a business card, tag, removable label and combinations thereof. In addition, the device 26 can be used as a carrier so that a removable element may be placed on the surface and removed such as through the use of a light tack adhesive, frangible coating or the like.

In addition, FIG. 1 shows personalized imaging 28 that has been provided on the inserts carried by the pocketed business communication as well as matching information 30 printed for exemplary purposes on pocket 18. Each pocket may be printed; both sides of the first and second faces may be provided with printing or imaging or any combination of those areas may be utilized to convey a particular message to the intended recipient.

Figure 2:
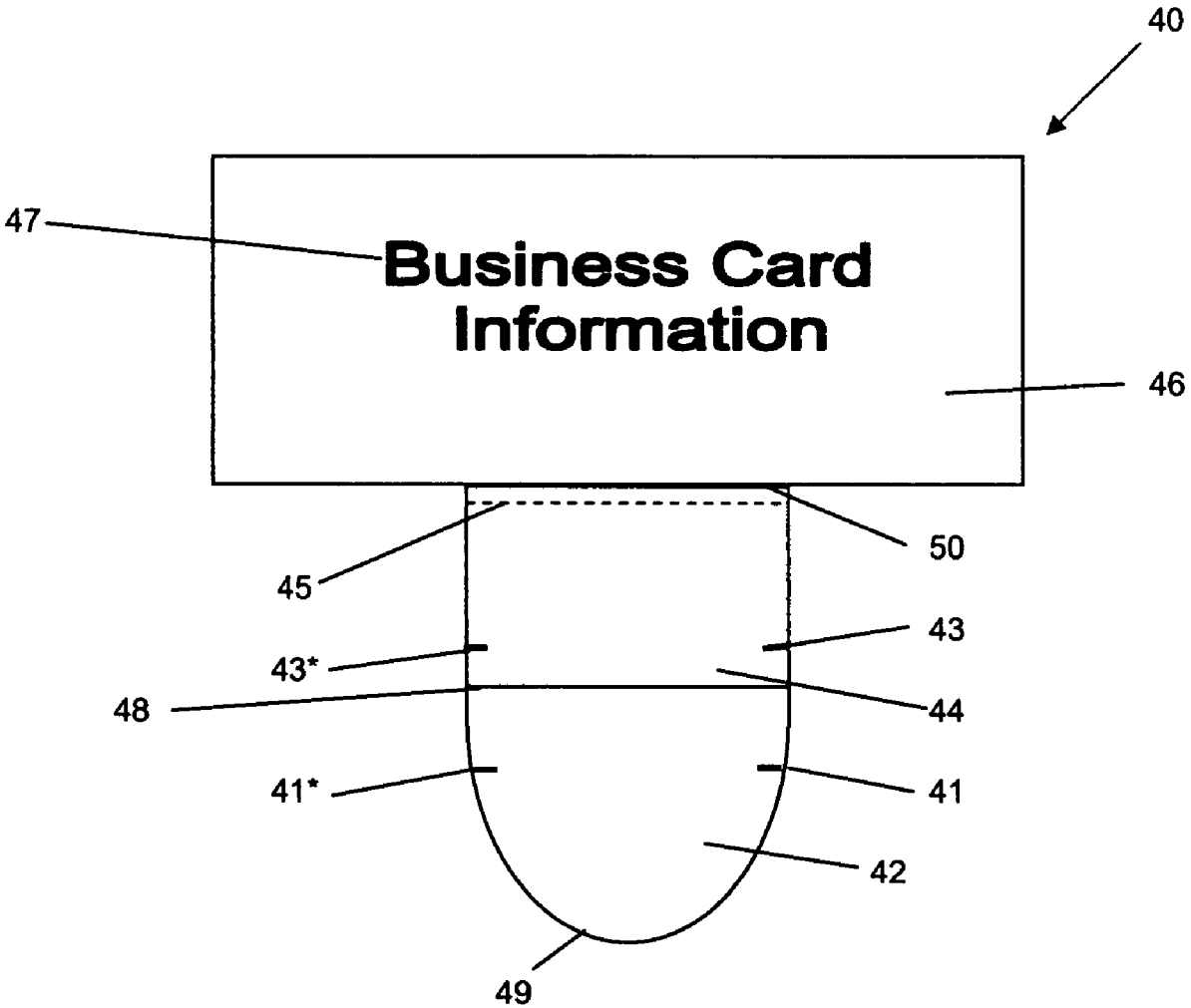
FIG. 2 shows a front view of the attention direction device used in accordance with the business communication piece.

Reference is now directed to FIG. 2 of the presently described invention which shows a top or front view of a blank of material that is used in forming the attention directing device which is generally depicted by numeral 40. The device includes a first panel 42, second panel 44 and third panel 46. The third panel 46 is depicted as being significantly larger than the first 42 and second panels 44 however it should be understood that the third panel 46 may be equivalent in size to the first and or second panels or any combinations thereof.

The first panel 42 is provided with a pair of slits 41 and 41* and the second panel is provided with a pair of slits 43 and 43* which run parallel to the pair of slits 41 and 41* of the first panel. The third panel 46 may be detached from the first 42 and second 44 panels by a line of weakness or perforation 45. The third panel 46 is also provided with imaging 47 which as shown depicts business card information, which may be for instance name, title, telephone and address details.

The first panel 42 is connected to the second panel 44 by a first fold line 48 and the second panel 44 is connected to the third panel 46 by a second fold line 50. The second fold line 50 and the line of weakness 45 may be one and the same.

The first panel 42 is provided with an arcuate end edge 49 which is on the opposite side from the fold line 48 on the first panel 42. The arcuate end edge 49 has been found to reduce the frictional engagement between the first panel 42 and the third panel 46 when the device 40 is erected as will be discussed, thereby allowing the device 40 to fully open to the desired position. That is, having a reduced surface area contact between the end edge of the first panel and the interior of the third panel, less energy is required for the resilient means connecting the first panel to the second panel so as to allow the first panel to "flip up" the third panel into is erected position.

Figure 3:
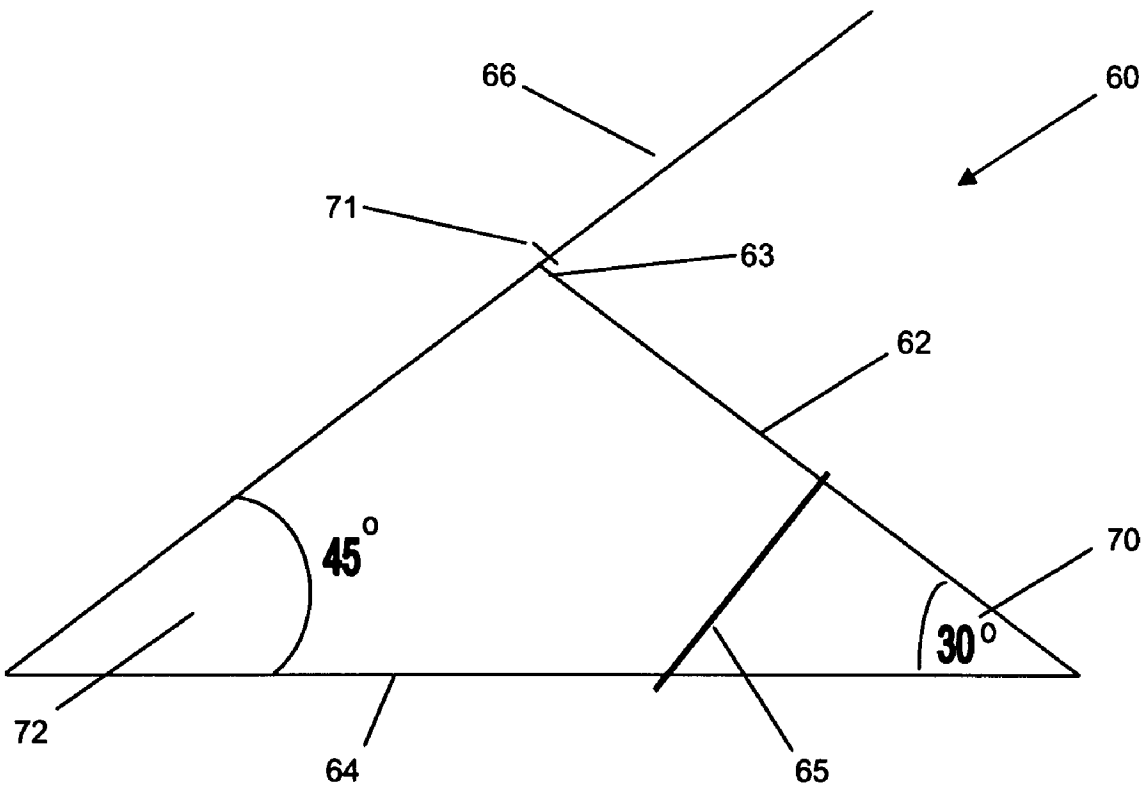
FIG. 3 illustrates an erected view of the attention direction device used in accordance with the business communication piece.

Attention is now directed to FIG. 3 which shows a side view of the attention directing device 40 shown in FIG. 2. In FIG. 3 the device is represented by numeral 60 and again includes first panel 62, second panel 64 and third panel 66. The arcuate end edge 63 is seen in proximate contact with panel 66. The first panel 62 and second panel 64 are connected to one another via a resilient retaining means 65, such as an elastic band, spring or other device which can aid in biasing the device 60 so that the device will open as shown in FIG. 3. As shown in FIG. 3, when open, the angle 70 between the first panel 62 and second panel 64 is greater than about ten degrees and more preferably about fifteen to about forty five degrees with about thirty degrees being preferred. The angle 72 between the second panel 64 and third panel 66 is greater than about thirty degrees and preferably about thirty five to seventy five degrees with about forty five degrees being preferred when the device 60 opens.

Numerical reference 71 is used to show the line of weakness between the second panel 64 and third panel 66. The line of weakness 71 allows the third panel 66 to be easily removed from the device 60 and the second panel 64.

The device 60 will operate from a closed position when engaged with the presentation folder to an open position when the pocketed business communication is opened as will be described herein. The device 60 opens through the use of the resilient biasing means 65 and in effect the first panel 62 moves upwardly so as to push panel 66 upwardly greater than about thirty degrees and more preferably to about forty five degrees so that the imaging on the third panel 66 is more clearly visible.

Figure 4:
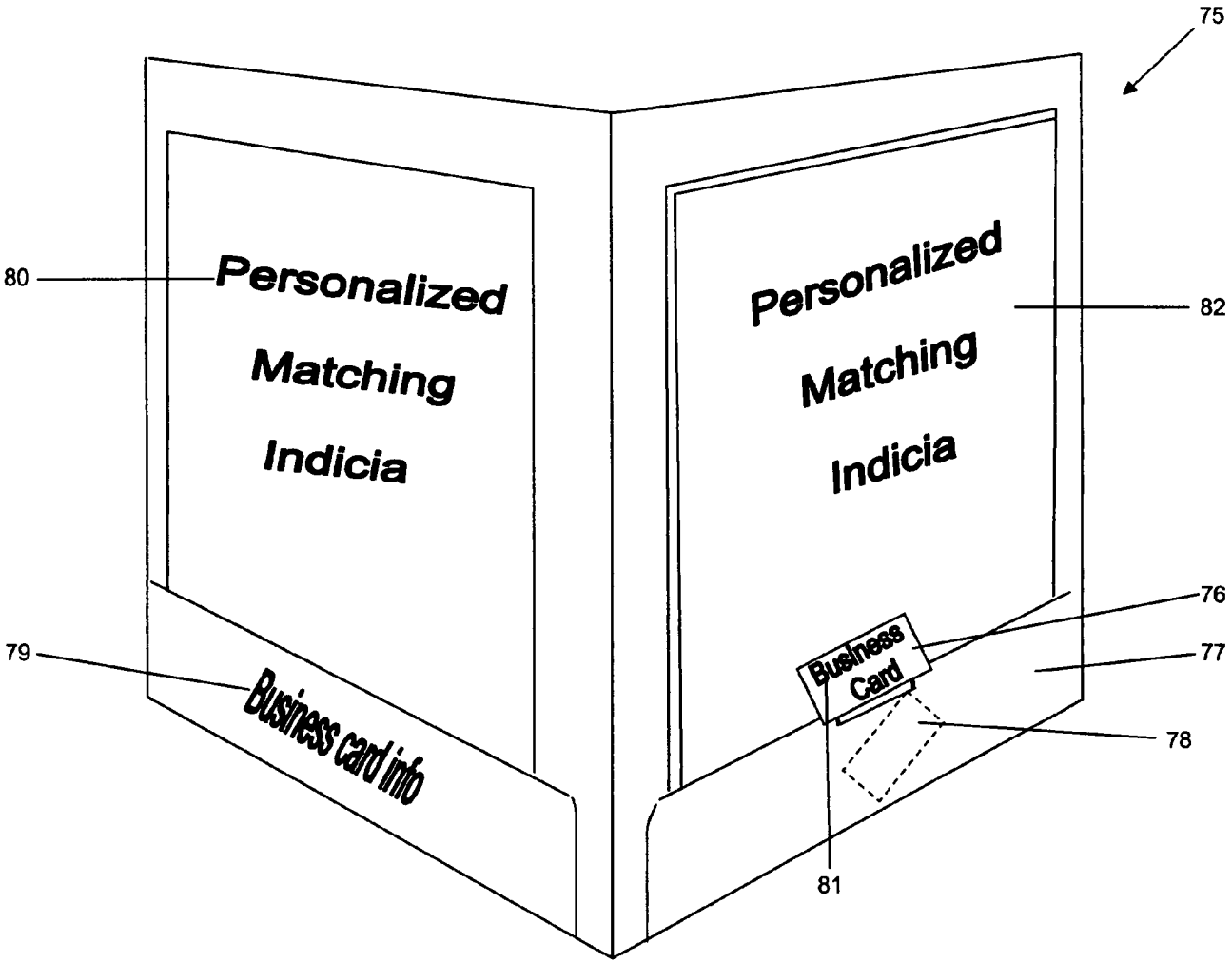
FIG. 4 presents an open view of the pocketed business communication illustrating the attention directing device and positioning of the sound emitting device.

Reference is now directed to FIG. 4 which illustrates a pocketed communication device generally designated by numeral 75 in an open configuration. The assembly shows the attention directing device 76 removably connected to pocket 77, through the use of slits as previously described and positioned adjacent the sound emitting device 78. It should be understood that while the sound emitting device 78 has been shown in an adjacent location to that of the attention directing device 76, the sound emitting device can be placed at any location on the communication 75.

FIG. 4 is also used to illustrate the placement and imaging of personalized and matching information which occurs on the attention direction device 76 in the form of imaging 81, on inserts as designated by 82, on pockets as designated by reference numeral 79 and additional inserts as indicated by reference numeral 80. In this fashion, the issuer of such communications can produce a complimentary message through out the communication assembly.

Figure 5:
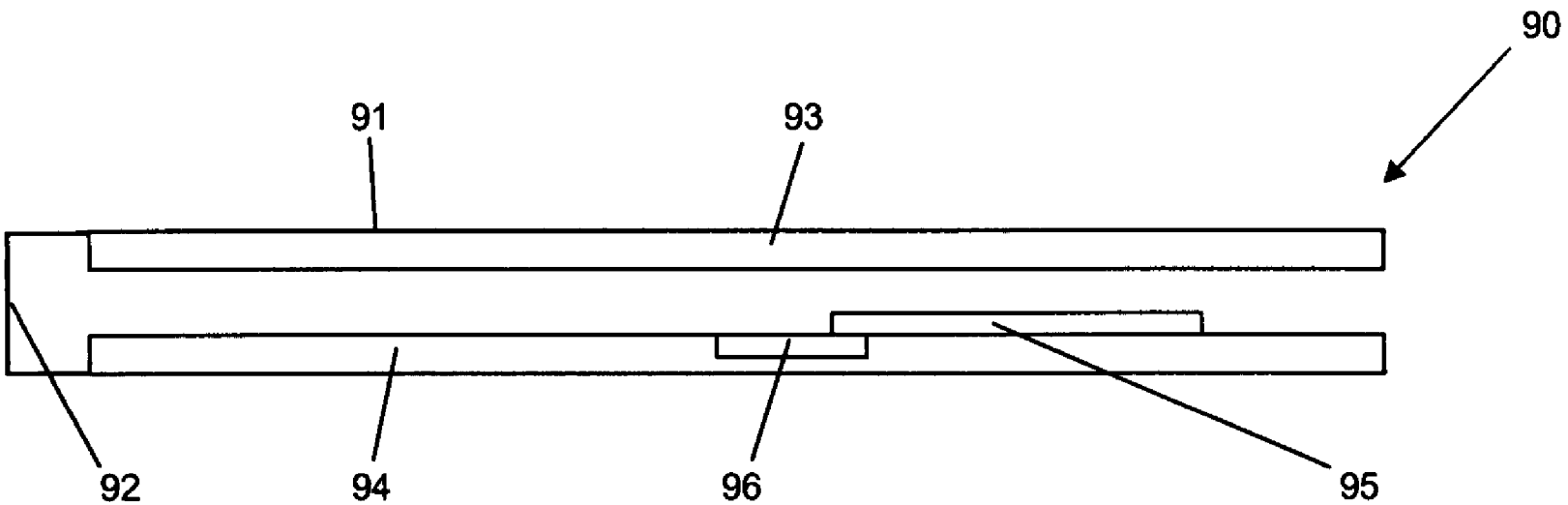
FIG. 5 depicts a side elevation of the pocketed business communication showing the attention directing device in a closed position.
Figure 6:
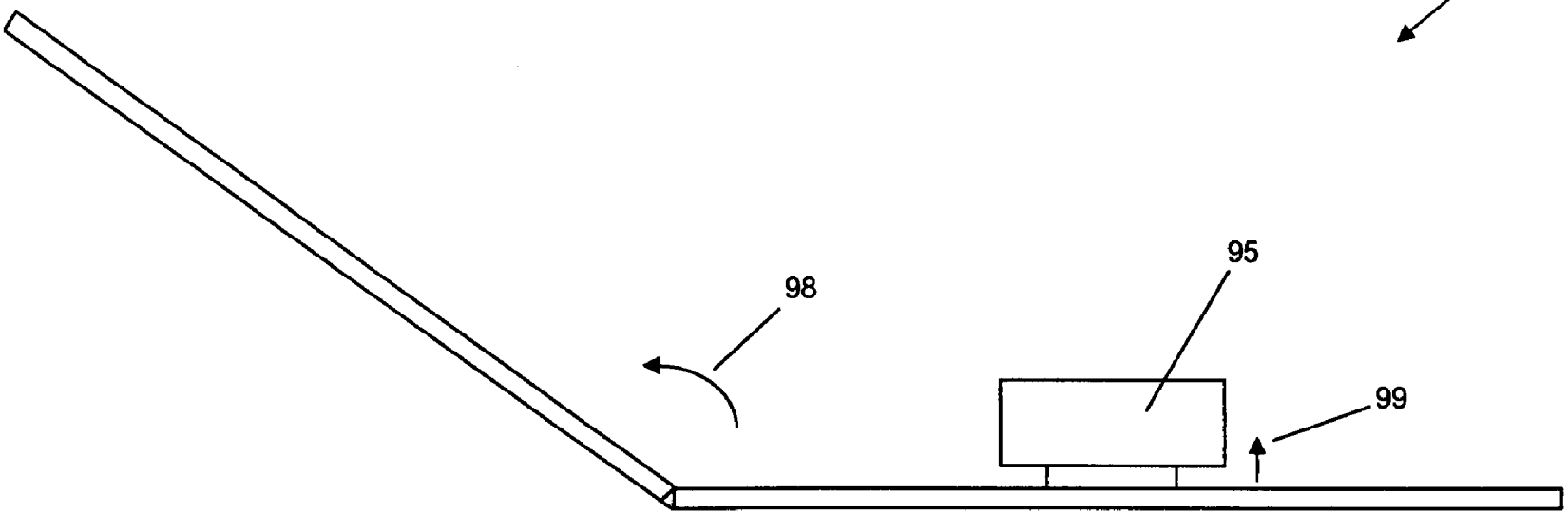
FIG. 6 shows a side elevation of the pocketed business communication showing the attention directing device in an open position.

FIGS. 5 and 6 are intended to show operation of the pocketed business communication assembly and the opening of the attention directing device. In FIG. 5, the presentation folder is represented by reference numeral 90. The folder 90 has faces 91 (second) and 92 (first) and first and second pockets 93 and 94, respectively. The pockets as described previously are on the first and second sides of the first face 92. The attention directing device 95 is shown in a closed position and adjacent the sound emitting device 96.

FIG. 6 shows the pocketed business communication assembly 90 in an open configuration as designated by arrow 98. Upon opening of the assembly 90, the attention directing device 95 moves upwardly as shown by arrow 99 so that the viewer of the assembly 90 has his/her attention drawn to the device 95 to alert the viewer to specific information or data.

The assembly described in connection with the present invention can be used in a number of applications from academic to professional as well as marketing and advertising. By being able to produce such communications in small or limited numbers, each assembly can then be tailored to meet the specific needs of each customer or situation thereby expanding the use and reach of such assemblies.

It will thus be seen according to the present invention a highly advantageous pocketed business communication with automatically actuated attention director has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

The invention claimed is:

1. A presentation folder having a plurality of pockets and an erectable attention directing device, comprising;

a presentation folder having first and second faces and first and second sides with each side of said first face having a pocket;

an attention directing device said device including first, second and third panels with said first panel connected to said second panel along a first fold line and said second panel connected to said third panel along a second fold line, said first panel having an arcuate end edge opposite said first fold line and said first panel is resiliently biased against said second panel by an elastic member;

said attention directing device operable between a first substantially flat position and a second open position in which said third panel is inclined and raised an amount greater than about thirty degrees from said second panel and said first panel is raised an amount greater than about ten degrees from said second panel in said second open position, said third panel overlying at least a portion of said first panel and said second panel;

said first and second panels each further including a pair of slits, with said slits in said second panel running parallel to said slits in said first panel and said elastic member placed such that a portion of said elastic member is positioned in each of said slits; and wherein each of said presentation folder and said attention directing device containing matching indicia printed at a resolution of greater than about 150 lines per inch.

2. A pocketed business communication having an attention directing feature, comprising;

a substantially planar blank of material having first and second faces with each face having first and second sides, said blank having first and second transversely extending edges and first and second longitudinally extending sides, said blank further including a central fold line extending substantially medially of said blank and extending between said first and second transversely extending edges and running parallel to said first and second longitudinally extending sides;

first and second pockets disposed on said first face with said first pocket disposed on said first side and said second pocket disposed on said second side, said first and second pockets are positioned adjacent said second transversely extending edge and are separated from one another by said fold line;

one of said first and second pockets having a passive retaining attachment area;

an automatically erectable attention directing device, said device having first, second and third panels with said third panel being larger than each of said first and second panels and said first panel including an arcuate end edge, said first panel is connected to said second panel along a first fold line and said second panel is connected to said third panel along a second fold line running parallel to said first fold line, said first panel is folded about said first fold line so as to be partially disposed over said second panel and said third panel is folded about said second fold line so as to be partially disposed over said first and second panels, and said second and first panels are further connected to one another by a resilient biasing piece to create said erectable attention directing device; and wherein said erectable attention directing device is held to said one of said first and second pockets by said passive retaining attachment area, such that when said blank is folded about said fold line said erectable directing device is held in a first closed position and when said blank is in a substantially planar position, said erectable directing device is in a second position such that said third panel is displayed at an angle greater than about twenty degrees from said second panel.

3. A pocketed business communication having an attention directing feature as recited in claim 2, wherein said resilient biasing piece is selected from a group including elastic bands, springs, coils, compressible elements and combinations thereof.

4. A pocketed business communication having an attention directing feature as recited in claim 2, wherein said third panel is displayed at an angle greater than about forty five degrees from said second panel.

5. A pocketed business communication having an attention directing feature as recited in claim 2, wherein said third panel includes a removable element selected from a group including business cards, tags, labels and combinations thereof.

6. A pocketed business communication having an attention directing feature as recited in claim 2, wherein said second fold line between said third panel and said second panel includes a line of perforation to enable said third panel to be separated from said second panel.

7. A pocketed business communication having an attention directing feature as recited in claim 2, wherein said erectable directing device is in a second position, said first panel is disposed at an angle greater than about ten degrees to said second panel.

8. A pocketed business communication having an attention directing feature as recited in claim 2, wherein said blank and said erectable directing device is imaged at a resolution greater than about 150 lines per inch.

9. A pocketed business communication having an attention directing feature as recited in claim 2, wherein said blank and said erectable directing device are imaged with matching information.

10. A pocketed business communication having an attention directing feature as recited in claim 2, wherein at least one of said first and second pockets is provided with a sound card to provide a message.

11. A pocketed business communication having an attention directing feature as recited in claim 2, wherein said passive retaining attachment area includes an adhesive selected from a group including repositionable, removable and combinations thereof.

12. A pocketed business communication having an attention directing feature as recited in claim 2, wherein said pocketed communication is a presentation folder.

13. A pocketed business communication having an attention directing feature as recited in claim 2, wherein said third panel is inclined from said second panel in said second position such that said third panel overlies at least a portion of said first and second panels.

14. A pocketed presentation folder assembly having an attention directing feature, comprising;

a presentation folder having first and second faces with each face having first and second sides, each of said first and second sides of said first face having a pocket disposed along a bottom end edge and said presentation folder including a fold line substantially dividing said faces into equal portions;

an attention directing feature including first, second and third panels with said first panel connected to said second panel along a first fold line and said second panel connected to said third panel along a second fold line, said first panel having an arcuate end edge opposite said first fold line and said first panel is resiliently biased against said second panel by an elastic member;

said attention directing device operable between a first substantially flat position and a second open position in which said third panel is inclined and raised an amount greater than about thirty degrees from said second panel and said first panel is raised an amount greater than about ten degrees from said second panel in said second open position, said third panel overlying at least a portion of said first panel and said second panel;

a sound producing device connected to one of said first and second pockets; and wherein said attention directing feature is disposed in proximity to said sound producing device and is attached to one of said first and second pockets such that when said attention direction feature is in said second position said sound producing device presents a message.

15. A pocketed presentation folder assembly having an attention directing feature as recited in claim 14, wherein said presentation folder and said attention directing feature are printed with matching indicia at a resolution of greater than about 150 lines per inch.

16. A pocketed presentation folder assembly having an attention directing feature as recited in claim 14, wherein said elastic member is a rubber band.

17. A pocketed presentation folder assembly having an attention directing feature as recited in claim 14, wherein said third panel of said attention directing feature is substantially greater than either of said first and second panels.

18. A pocketed presentation folder assembly having an attention directing feature as recited in claim 14, wherein said third panel of said attention directing feature is a business card.

19. A pocketed presentation folder assembly having an attention directing feature as recited in claim 14, wherein said elastic member is secured to said first and second panels through a series of slits.

20. A pocketed presentation folder assembly having an attention directing feature as recited in claim 14, wherein said attention directing feature is secured to said one of said first and second pockets by a plurality of parallel slits.

* * * * *